United States Patent [19]

Kösters et al.

[11] Patent Number: 5,043,022

[45] Date of Patent: Aug. 27, 1991

[54] METHOD OF TREATING A ONE-SIDE ELECTROGALVANIZED STEEL SHEET

[75] Inventors: Kurt Kösters, Punchenau; Franz M. Androsch, Linz; Dieter Paesold, Neuhofen/Krems, all of Austria

[73] Assignee: Voest-Alpine Stahl Linz Gesellschaft Mibitt, Austria

[21] Appl. No.: 387,080

[22] Filed: Jul. 28, 1989

[30] Foreign Application Priority Data

Jul. 28, 1988 [EP] European Pat. Off. ..... 88890198.0

[51] Int. Cl.[5] ..... C23G 1/02

[52] U.S. Cl. ..... 134/3; 134/15; 134/42; 134/122 R; 252/100; 252/142; 427/132; 427/406

[58] Field of Search ..... 134/2, 3, 40–42, 134/15, 122 R, 64 R; 252/106, 100, 95, 142; 208/46; 427/132, 406

[56] References Cited

U.S. PATENT DOCUMENTS

| | | | |
|---|---|---|---|
| 3,537,926 | 11/1970 | Fischer | 156/903 |
| 4,545,918 | 10/1985 | Pralies | 134/3 |
| 4,659,605 | 4/1987 | Malik et al. | 427/132 |
| 4,857,225 | 8/1989 | Terada et al. | 134/3 |

*Primary Examiner*—Anthony McFarlane

*Attorney, Agent, or Firm*—Ostrolenk, Faber, Gerb & Soffen

[57] ABSTRACT

In a method of treating one-side electrogalvanized steel sheets, the uncoated side is contacted with an aqueous pickling solution containing a water-soluble hydroxycarboxylic acid and a water-soluble peroxo compound. In this way, extremely resistant mixed oxides are separated from one-side electrogalvanized sheets, which, otherwise, would lead to stripy yellowish and brownish stains on the uncoated steel surface. In addition, the new metal surface formed is passivated.

11 Claims, 1 Drawing Sheet

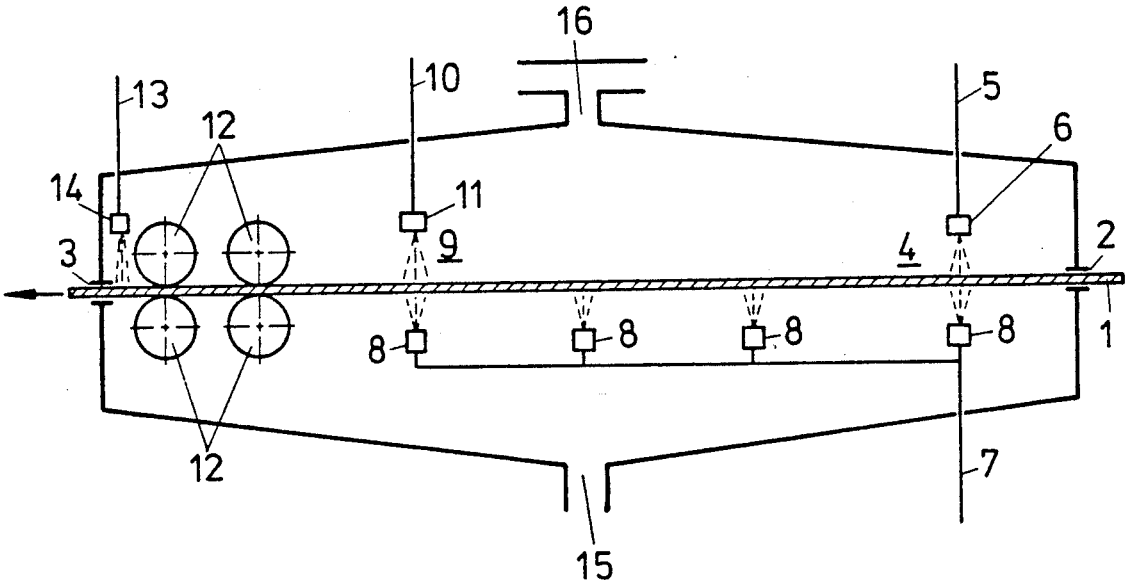
16
10
5
13
12
6
14
11
9
4
2
3
8
8
8
8
1
12
7
15

METHOD OF TREATING A ONE-SIDE ELECTROGALVANIZED STEEL SHEET

The invention relates to a method of treating one-side electrogalvanized steel sheets.

If steel sheets are electrolytically zinc-coated on one side, stripy yellowish and brownish stains of various intensities appear on the bare steel surface. The stain-causing deposits, which have a thickness of about 10 to 100 nm, are formed due to incipient rust developed in the galvanizing and spraying sections of the galvanizing plant. This incipient rust development is a post-reaction due to the degreasing and pickling of the steel surface necessary in the course of the preliminary treatment immediately prior to zinc-coating. These stains are additionally influenced and intensified by effects inherent in the sheet, by thermal treatments at the production of the sheet and by the operational parameters of electrogalvanizing.

The deposits in question basically differ from conventional rust, which, for instance, forms on iron surfaces in the free air: While conventional incipient rust is removable from the iron surface by heating in diluted hydrochloric acid under formation of soluble ferric chloride, this is not feasible with the deposits concerned. Rather, they are that resistant that they cannot be dissolved even by hot 10% hydrochloric acid. This unusual chemical behavior appears to be due to ironmanganese spinels present in the yellowish and brownish stains of the uncoated surface.

The removal of these deposits is desirable, for they constitute a quality reduction of the sheet zinc-coated on one side, even though these deposits merely affect the appearance, but not further processing, of the sheets.

The invention has as its object to provide a method of removing the deposit on the non-coated face of one-side galvanized steel sheets, which method, in addition, ensures the passivation of the metallic surface thus produced in a manner that no ferrous hydroxide film will form at a later time, wherein the zinc-coated side, naturally, must not be affected thereby.

In accordance with the invention this object is achieved in that the uncoated side is contacted with an aqueous pickling solution containing a water-soluble hydroxycarboxylic acid and a water-soluble peroxo compound, preferably hydrogen peroxide.

Hydroxy carboxylic acids that carry the hydroxyl group and the carboxyl group on one and the same carbon atom are particularly suitable, such as, e.g., malic acid or, in particular, citric acid, the latter having proved particularly suitable.

Advantageously, the pickling solution has a pH of from 1.0 to 3.5, preferably 2.0 to 3.5, the hydroxycarboxylic acid being present at a concentration of 10 to 100 g/l and the peroxo compound being present at a concentration corresponding to 0.1 to 7 g active oxygen/liter.

To adjust the pH of the pickling solution, an inorganic acid may be additionally admixed.

It has been surprising to one skilled in the art that the pickling solution according to the invention is able to dissolve such a particularly resistant deposit, because the acidity of hydroxycarboxylic acids ranges far below that of hydrochloric acid and the reaction temperature is relatively low, preferably 40° C. at the most.

This surprising effect goes back to the co-action of the hydroxycarboxylic acid with the peroxo compound, wherein the acid, complexing and oxidizing activities of this combination also take effect. It is supposed that the oxidizing agent at first oxidizes the hardly soluble metal oxides to superior oxides, which are more readily soluble and, therefore, susceptible to being attacked by hydroxycarboxylic acid. It is the interplay of the acid, oxidizing and complexing effects to which the special solubilizing capacity of the pickling solution used according to the invention is attributed. It has been observed that the reactivity of the pickling solution is the higher the smaller its content of $Fe^{3+}$. A particularly high reactivity prevails if the content of $Fe^{3+}$ lies below 50 mg/liter.

Methods of derusting and descaling metallic surfaces are, of course, known in the literature; yet, there is no method that deals with the separation of the completely different and particularly resistant oxide layer forming at electrogalvanizing.

DE-A 29 42 934 relates to a method of separating surface oxidic layers that form during the thermal treatment of steel sheets, by means of organic acids. To regenerate the pickling solution, $Fe^{2+}$ is oxidized to $Fe^{3+}$ by adding $H_2O_2$, the latter Fe being precipitable as such.

DE-B—20 41 871 describes a method of pre-treating steel sheets prior to being phosphated and subsequently painted with a derusting agent containing more than 5% citric acid.

According to DE-A 25 04 990, magnetite is removable from metallic surfaces by a pickling solution containing an organic acid.

None of these methods is suited to the separation of particularly resistant oxidic layers on the uncoated side of one-side zinc-coated steel sheets.

In contrast to known pickling solutions, the pickling solution used according to the invention, thus, exhibits both an acid and a complexing and oxidizing action. The interplay of these three actions is supposed to be responsible for the special solubilizing capacity and the passivating effect of the pickling solution according to the invention.

The method according to the invention is easy to carry out by continuously guiding the steel sheet through a pickling zone, in which the bare side is sprayed with pickling solution and the zinc-coated side is sprayed with water, each homogenously over the entire width of the steel sheet, and then through a washing zone, in which the two sides are rinsed with water, which is subsequently squeezed off, whereupon additional rinsing with water is effected, if necessary.

Thereby, it is ensured that the method according to the invention is integratable into any desired electrogalvanizing plant without any problems and at little expenditures.

Furthermore, the invention comprises a one-side electrogalvanized steel sheet which is characterized in that the surface of the uncoated side is free of oxides forming during galvanizing and is passivated by a hydroxycarboxylic acid, preferably citric acid.

The implementation of the method according to the invention will be explained in more detail with reference to the drawing.

The drawing schematically shows a cross section through a chamber in which the pickling and rinsing of the one-side zinc-coated steel sheets are carried out. By 2 the entry and by 3 the exit for the steel sheets 1 traveling therethrough are denoted, the traveling direction being indicated by an arrow. The steel sheets are led into a front pickling zone 4 with the bare side upwards, in which they are sprayed with pickling solution from above and with water from below. The pickling solution is supplied in a duct 5 to a spraying beam 6, which sprays the pickling solution transversely over the entire width of the steel sheet. In order to prevent the pickling solution from getting onto the zinc-coated side of the steel sheet, the sheet is sprayed with water from below, which is supplied in duct 7 to several spraying beams 8 also covering the entire width of the steel sheet.

After having passed the pickling zone 4, the steel sheets reach the washing zone 9 in which the pickling solution is rinsed off with water supplied to the spraying beam 11 by means of a duct 10. The reaction distance resulting from the distance of the two spraying beams 6 and 11 amounts to about 1 m. This short reaction distance suffices to dissolve the oxidic layer, the steel sheets being guided through the chamber at a speed of up to 90 m/min. In order to eliminate a possible final residue of pickling solution from the steel sheets, the water sprayed onto the same is removed by squeezing rolls 12 and, if desired, the pickled surface is sprayed once more with water supplied to a spraying beam 14 through duct 13. Openings 15 and 16 are provided at the chamber to let washings be discharged and sprinkles be sucked off.

The invention will be further explained in the following example:

One-side zinc-coated steel sheets having a thickness of 0.8 mm and a width of 1,500 mm were guided through the pickling zone 4 at a speed of 40 m/min. The uncoated side was sprayed with 10 liters of pickling solution per minute homogenously over its entire width. The pickling solution had a temperature of 40° C. and contained 25 g/l citric acid and 0.60% by vol. hydrogen peroxide.

After the washing procedure, the uncoated side proved to be free of mixed oxides, which would lead to staining, and to be passivated by citric acid. The zinc-coated side had not been affected by pickling.

Similarly good results were obtained when using malic acid or tartaric acid (also at concentrations of 25 g/l) instead of citric acid as hydroxycarboxylic acids, or when using ammonium peroxodisulfate (at a concentration of 24 g/l) instead of hydrogen peroxide.

What we claim:

1. A method of treating a one-side electrogalvanized steel sheet having an uncoated side and a zinc-coated side to remove deposits on said uncoated side and passivate said uncoated side, which method comprises contacting said uncoated side with an aqueous pickling solution, said aqueous pickling solution containing a water-soluble hydroxycarboxylic acid, a water-soluble peroxo compound and less than 50 mg/l $Fe^{3+}$.

2. A method as set forth in claim 1, wherein said water-soluble peroxo compound is hydrogen peroxide.

3. A method as set forth in claim 1, wherein the hydroxyl group and carboxylic group of the hydrocarboxylic acid are attached to the same carbon atom.

4. A method as set forth in claim 3, wherein said hydroxycarboxylic acid is citric acid.

5. A method as set forth in claim 1, wherein said pickling solution has a pH of from 1.0 to 3.5, said hydroxycarboxylic acid is present at a concentration of from 10 to 100 g/l and said peroxo compound is present at a concentration corresponding to 0.1 to 7 g active oxygen/liter.

6. A method as set forth in claim 5, wherein said pH of said pickling solution ranges between 2 and 3.5.

7. A method as set forth in claim 5, further comprising adding an inorganic acid to to said pickling solution to adjust the pH thereof.

8. A method as set forth in claim 1, wherein a pickling zone is provided for continuously moving said steel sheet therethrough while spraying said pickling solution onto said uncoated side of said steel sheet and water onto said zinc-coated side of said steel sheet, each homogenously over the entire width of said steel sheet, and subsequently a washing zone is provided for rinsing said uncoated and said zinc-coated sides with water, which is squeezed off afterwards.

9. A method as set forth in claim 8, wherein said uncoated and said zinc-coated sides are rinsed with water a second time after squeezing off.

10. A one-side electrogalvanized steel sheet having an uncoated side and a zinc-coated side and produced by treatment of said uncoated side with an aqueous pickling solution containing a water-soluble hydroxycarboxylic acid, a water-soluble peroxo compound and less than 50 mg/l $Fe^{3+}$, wherein said uncoated side is free of the deposition of oxides during the galvanizing and treatment.

11. A steel sheet as set forth in claim 10, wherein said hydroxycarboxylic acid is citric acid.

* * * * *